United States Patent [19]

Okabe et al.

[11] Patent Number: 4,519,207

[45] Date of Patent: May 28, 1985

[54] COMBINED PLANT HAVING STEAM TURBINE AND GAS TURBINE CONNECTED BY SINGLE SHAFT

[75] Inventors: Akira Okabe; Haruo Urushidani; Katsuto Kashiwahara, all of Hitachi, Japan

[73] Assignee: Hitachi, Ltd., Tokyo, Japan

[21] Appl. No.: 452,935

[22] Filed: Dec. 27, 1982

[30] Foreign Application Priority Data

Dec. 29, 1981 [JP] Japan ..... 56-210662

[51] Int. Cl.[3] ..... F02C 6/18

[52] U.S. Cl. ..... 60/39.182; 122/7 R

[58] Field of Search ..... 60/39.182, 676; 122/7 R, 7 B

[56] References Cited

U.S. PATENT DOCUMENTS 3,204,407 9/1965 Meissenberg et al. ..... 60/39.182

4,212,160 7/1980 Blaskowski ..... 60/39.182

4,267,692 5/1981 Earnest ..... 60/39.182

FOREIGN PATENT DOCUMENTS 2076062 11/1981 United Kingdom ..... 60/39.182

*Primary Examiner*—Louis J. Casaregola

*Attorney, Agent, or Firm*—Antonelli, Terry & Wands

[57] ABSTRACT

A combined plant including a gas turbine, a steam turbine and a waste heat recovery boiler using exhaust gases of the gas turbine as a heat source for producing steam serving as a drive source of the steam turbine further includes an ancillary steam source separate from and independent of the waste heat recovery boiler. At the time of startup of the plant, steam from the ancillary steam source is introduced into the steam turbine until the conditions for feeding air to the waste heat recovery boiler are set, to thereby avoid overheating of the steam turbine due to a windage loss.

6 Claims, 6 Drawing Figures

COMBINED PLANT HAVING STEAM TURBINE AND GAS TURBINE CONNECTED BY SINGLE SHAFT

BACKGROUND OF THE INVENTION

This invention relates to combined plants having a steam turbine and a gas turbine connected together by a single shaft, and, more particularly, to a combined plant which is capable of operating in safety by avoiding overheating of the steam turbine that might otherwise occur due to a windage loss possibly caused by no load operation of the plant, or when operation is accelerated at the time of startup.

In this type of single-shaft combined plant of the aforemented type the steam turbine and gas turbine can be simultaneously started and accelerated. Thus, this type of plant offers the advantage that, as compared with multiple-shaft type combined plants in which the steam turbine and gas turbine are supported by separate shafts, it is possible to shorten the time required for achieving startup because the steam turbine and gas turbine can be simultaneously accelerated.

However, in this type of single-shaft combined plant, feeding of air to the steam turbine is not obtainable until the gas turbine is first accelerated and its exhaust gases are led to a waste heat recovery boiler to generate steam by using the exhaust gases as a heat source.

Generally, in a single-shaft type combined plant, the gas turbine can be usually accelerated to its rated rotational speed in about ten minutes following plant startup but the waste heat recovery boiler is unable to generate steam of sufficiently high temperature and pressure to supply air to the steam turbine in this period of time. Particularly the amount of waste heat released from the gas turbine is substantially proportional to the gas turbine load, so that it takes a prolonged period of time for the steam generating condition of the waste heat recovery boiler to be established when, for example, a no load condition prevails at the time of startup. Since the gas turbine and the steam turbine are connected together by a single shaft in a single-shaft type combined plant, the steam turbine can also attain its rated rotational speed in about ten minutes following plant startup. Prior to startup, the steam turbine has its interior evacuated with a vacuum pump, for example, to maintain the condenser in vacua. However, at plant startup, the pressure in the condenser is raised to a level higher than that prevailing in steadystate condition (or near the atmospheric pressure). If the turbine rotor rotates at high speed, the rotor temperature rises due to a windage loss. Particularly in the low pressure final stage of the turbine or stages near it, the rise in temperature due to a windage loss is marked because the turbine has elongated rotor blades and a high peripheral velocity. Centrifugal stresses developing in the roots of the blades are higher in the final stage and stages near it than in an initial stage of the turbine, so that if the temperature in this part of the turbine shows a marked rise in temperature due to a windage loss the material would undesirably be greatly reduced in strength.

In the event that the temperature of the steam in the inlet of a steam turbine shows an inordinate rise the turbine can be tripped by means of a safety device. The provision of the safety device raises the problem that the turbine is liable to be tripped due to a rise in the temperature of the final stage of the steam turbine at plant startup, thereby rendering plant startup impossible to accomplish.

SUMMARY OF THE INVENTION

An object of this invention is to provide a combined plant having a steam turbine and a gas turbine connected together by a single shaft which is capable of avoiding overheating of the steam turbine at the time the steam turbine is accelerated and operated under no load condition.

Another object is to provide a combined plant of the type described which is capable of keeping the outlet temperature of the steam turbine at a level below an allowed value to avoid tripping of the turbine.

The outstanding characteristic of the invention is that there is provided, in a combined plant provided with a waste heat recovery plant using exhaust gases from the gas turbine as a heat source for generating steam serving as a drive source of the steam turbine connected to the gas turbine by a single shaft, an ancillary steam source for supplying steam through an ancillary steam line connected to a steam line for introducing steam from the waste heat recovery boiler into the steam turbine. The ancillary steam line has mounted therein an ancillary steam control valve adapted to be brought to an open position when the plant is started to allow ancillary steam to be led to the steam turbine to obtain cooling of the steam turbine.

The ancillary steam supplied to the steam turbine at plant startup is low in temperature because it undergoes expansion at each stage of the turbine to release energy, so that its temperature drops to a sufficiently low level to allow cooling of the steam turbine to be effected in the vicinity of the final stage. Control of the amount of the ancillary steam enables the temperature of the steam turbine to be controlled.

DETAILED DESCRIPTION OF THE INVENTION

Figure 1:
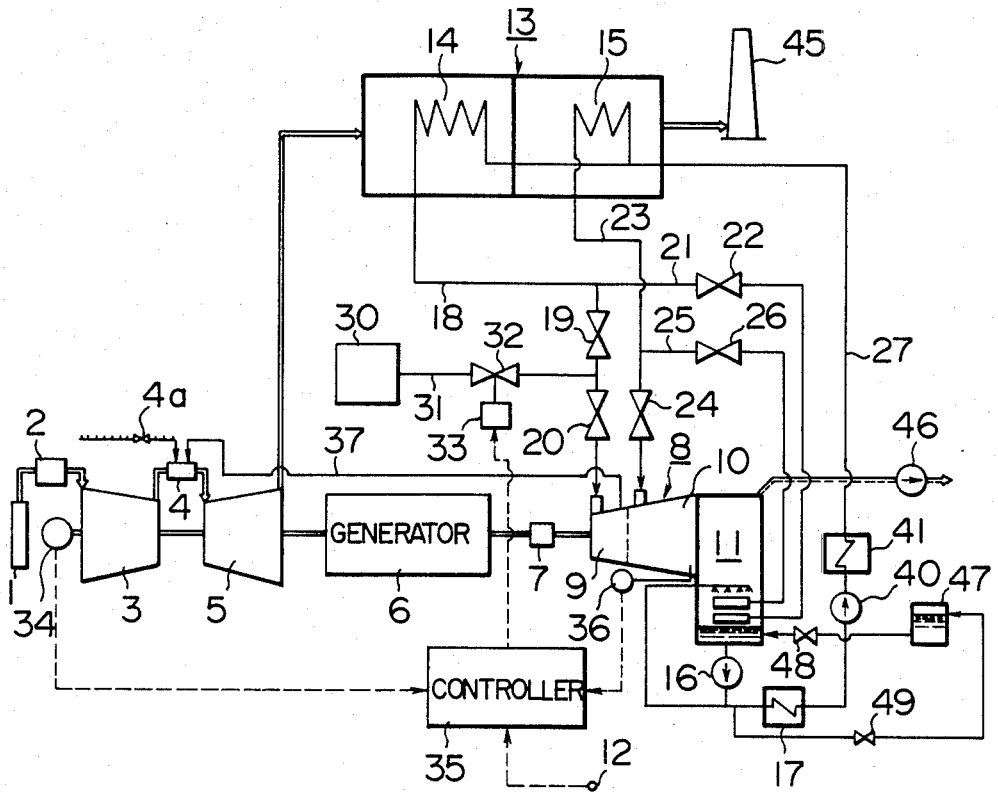
FIG. 1 is a schematic view of a combined plant provided with an ancillary steam system comprising one embodiment of the invention.

Referring now to the drawings wherein like reference numerals are used throughout the various views to designate like parts and, more particularly, to FIG. 1, according to this figure, a combined plant of the single shaft type comprises a compressor 3, a gas turbine 5 and a generator 6 constituting a gas turbine device which is connected to a steam turbine 8 by a single shaft through a coupling 7. Air is led through an air inlet 1 and a silencer 2 into the compressor 3 where it is compressed and mixed with a fuel gas in a combustor 4 and burned therein to produce a gas of high temperature and pressure which flows into the gas turbine 5 where the gas of high temperature and pressure has its energy converted to energy of rotation. After the gas of high temperature and pressure has done work at the gas turbine 5, exhaust gases are supplied to a waste heat recovery boiler generally designated by the reference numeral 13 as a heating fluid where the thermal energy is recovered before the exhaust gases are released to the atmosphere through a smoke stack 45. The waste recovery boiler 13 comprises a high pressure steam generator 14 and a low pressure steam generator 15. Steam produced by the high pressure steam generator 14 is led through a high pressure steam line 18 via a high pressure steam stop valve 19 and a high pressure steam control valve 20 into a high pressure turbine 9. When no higher pressure steam condition is established at the time of startup, the steam is bypassed through a high pressure bypass line 21 via a high pressure bypass valve 22 to a condenser 11. The low pressure steam generator 15 produces low pressure steam flowing through a low pressure steam line 23 via a low pressure steam stop valve 24 into a low pressure turbine 10. Steam exhausted from the steam turbine 8 is changed into a condensate at the condenser 11 which flows through a condensate pump 16, a gland condenser 17, a feedwater pump 40 and a feedwater heater 41, to be returned through a feedwater line 27 to the waste heat recovery boiler 13. The steam flows to the condenser 11 through a low pressure bypass line 25 branching from the low pressure steam line 23 via a low pressure bypass valve 26 mounted in the line 25 when no air feeding condition is established at the time the plant is started, as is the case with the steam flowing to the condenser via the high pressure bypass valve 22.

An ancillary steam source 30 is connected through an ancillary steam line 31 via an ancillary steam control valve 32 to a portion of the high pressure steam line 18 intermediate the high pressure steam stop valve 19 and high pressure steam adjusting valve 20.

The condenser 11 is provided with a vacuum pump 46 for reducing the internal pressure of the condenser 11 prior to starting the steam turbine 8, and is connected to a feedwater tank 47 through valves 48 and 49 to keep the level of the condenstate substantially constant. The ancillary steam control valve 32 is controlled by an actuator 33 which, in turn, is actuated by a signal from a controller 35. The controller 35 has supplied thereto, through a terminal 12, a plant starting signal, a temperature signal based on the measurement of the temperature of the final stage or the outlet of the steam turbine 8 obtained by a thermocouple 36, and a speed signal based on the measurement of the speed of rotation of the turbine by a tachometer 34 or a signal indicating the lapse of time following plant startup, to calculate the degree of opening of the ancillary steam control valve 32 based on these signals. A fuel control valve **4*a* controls the amount of fuel supplied to the gas turbine combustor 4, and a line 37 supplies steam extracted from the high pressure turbine 9 to the combustor 4. Supply of the steam extracted from the high pressure turbine 9 to the combustor 4 has the effect of avoiding generation of oxides of nitrogen when the temperature of the combustor 4** rises during a high load operation.

In the combined plant of the aforesaid construction, when the plant is in steadystate operation condition, the high pressure bypass valve 22 and low pressure bypass valve 26 as well as the ancillary steam regulating valve 32 are all in fully closed position and high pressure steam is supplied to the high pressure turbine 9 through the high pressure steam line 18 via the high pressure steam stop valve 19 and high pressure steam control valve 20 while low pressure steam is supplied to the low pressure turbine 10 through the low pressure steam line 23 via the low pressure steam stop valve 24. Steam generated by the waste heat recovery boiler 13 when the plant is in steadystate operation condition is under conditions enough to actuate the steam turbine 8.

Figure 3:
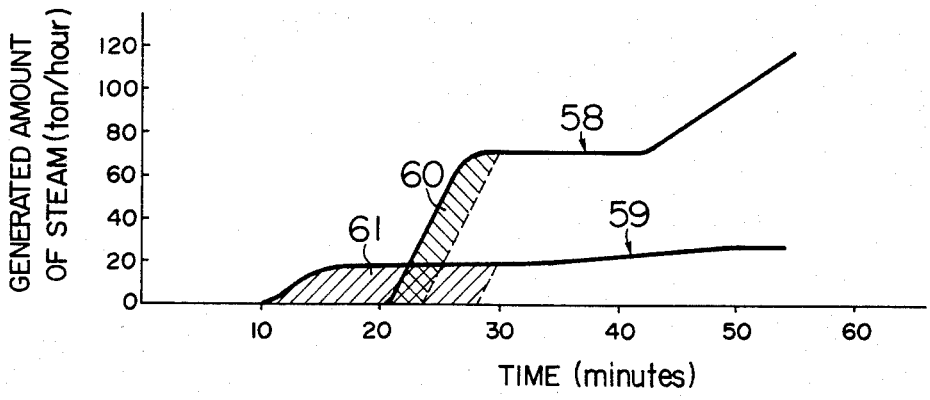
FIG. 3 is a graph showing the amount of steam generated by the waste heat recovery plant, in chronological sequence from the time the plant is started.
Figure 4:
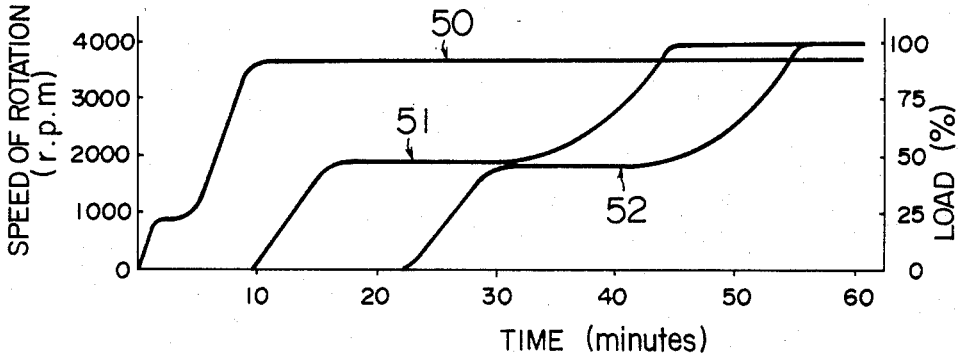
FIG. 4 is graph showing the relation between the rotational speed of the turbine and the turbine load, in chronological sequence from the time the plant is started.

When the plant remains inoperative, prior to starting the plant, the vacuum pump 46 is actuated to reduce the internal pressure of the steam turbine 8 and condenser 11 to bring the plant to a standby position. Then the gas turbine combustor 4 is ignited and the amount of fuel supplied to the combustor 4 is increased. As shown in FIG. 4, the speed of rotation of the gas turbine 5 reaches its rated speed of rotation of 3600 rpm. about ten minutes after the plant is started, as indicated by a curve 50. When the gas turbine 5 reaches the rated speed, the speed of rotation of the steam turbine 8 naturally reaches the same speed of rotation. As indicated by a curve 59 in FIG. 3, the amount of steam generated by the waste heat recovery plant 13 is such that ten minutes after the plant startup and the gas turbine 5 attains its rated speed, the low pressure steam generator 15 starts producing steam. The steam generated is the problem wet steam and would cause the problem corrosion of the turbine rotor to occur if it is supplied to the low pressure turbine 10, so that it is released to the condenser 11 by bringing the low pressure steam stop valve 24 to fully closed position and bringing the low pressure bypass valve 26 to an open position. A hatched zone 61 in FIG. 3 represents the amount of steam released to the condenser 11 through the bypass line 25. Likewise, as indicated by a curve 58 in FIG. 3, high pressure steam is generated about twenty minutes after the plant startup and a gas turbine load 51 (see FIG. 4) reaches about 50%. However, when steam conditions are not ready yet, the high pressure steam stop valve 19 is closed and the high pressure bypass valve 22 is open to allow steam represented by a hatched zone 60 to flow directly to the condenser 11. Thus, no steam is supplied to the steam turbine 8 from the waste heat recovery boiler 13 for 20–30 minutes following plant startup. During this period, the rotor of the steam turbine 8 is rotated in the air of reduced pressure, and the temperature is raised by a windage loss as described hereinabove.

Meanwhile at plant startup, the ancillary steam control valve 32 is kept at a predetermined degree of opening by a signal from the controller 35 to supply ancillary steam to the high pressure turbine 9 through the control valve 32. Doing work in the high pressure turbine 9 and low pressure turbine 10, the ancillary steam has its temperature reduced in going to the later stages until at the final stage the temperature is reduced to about 50° C. Thus, the heat generated by the windage loss is carried away by the steam, so that there is no inordinate rise in temperature in the final stage and stages in its vicinity.

The amount of heat carried away by the ancillary steam is substantially proportional to the flow rate of the ancillary steam. Thus, the opening of the control valve 32 is controlled by measuring the outlet temperature of the steam turbine 8 by a thermocouple 36 to increase the amount of the ancillary steam when the outlet temperature rises. The heat produced by the windage loos increases in accordance with the speed of rotation of the rotor, so that the opening of the control valve 32 is controlled by a signal from the tachometer 34. When the gas turbine load 51 (see FIG. 4) reaches 50% and about ten minutes after that, conditions for both the high pressure steam and low pressure steam are set, so that feeding of air to the steam turbine 8 is initiated. When air is fed to the steam turbine 8, the high pressure steam stop valve 19 and low pressure steam stop valve 24 are opened and the bypass valves 22 and 26 are closed. As soon as feeding of air is initiated, the ancillary steam control valve 32 is brought to fully closed position to start steadystate operation.

Ancillary steam led from the ancillary steam source 30 is passed to the low pressure steam line 23 on the upstream side of the low pressure steam stop valve 24 through the ancillary steam line 31 via the ancillary steam control valve 32, and a check valve 28 is mounted between a point 38 at which the low pressure steam line 23 is connected to the ancillary steam line 31 and the low pressure bypass line 25, to avoid inflow of the ancillary steam into the low pressure bypass line 25. At this time, the ancillary steam led from the ancillary steam source 30 warms up the low pressure steam stop valve 24 before flowing into the low pressure turbine 10 where the steam does work and has its temperature reduced to cool the outlet of the low pressure turbine 10. Meanwhile, the steam flowing back to the high pressure turbine 9 warms up the high pressure turbine 9 that has been heated by a windage loss and then warms up the high pressure steam control valve 20. The high pressure bypass line 21 is communicated with a portion of a line connecting the high pressure steam stop valve 19 and high pressure steam control valve 20 through a line 39 via a valve 29, so that the steam passing through the high pressure steam control valve 20 flows through the line 39 and valve 29 and via the high pressure bypass line 21 to the condenser 11. The line 39 may alternatively be connected to the low pressure bypass line 25 or directly to the condenser 11. Since the high pressure bypass line 21 is designed to allow high temperature steam to flow therethrough, steam having its temperature raised to about 500° C. by a windage loss is advantageously passed through the high pressure bypass line 21.

Figure 2:
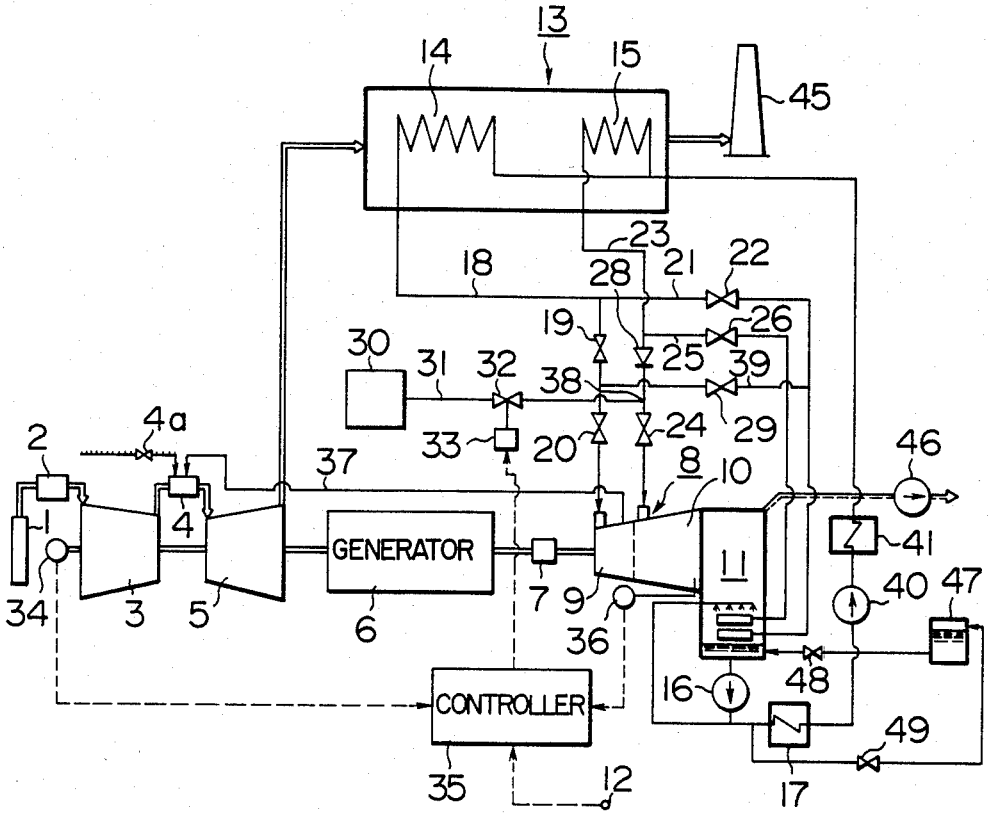
FIG. 2 is a schematic view of the combined plant provided with an ancillary steam system comprising another embodiment of the invention.

In the embodiment shown in FIG. 2, the valve 29 is opened and closed by the same signal that opens and closes the bypass valves 22 and 26. Basically the ancillary steam control valve 32 is controlled by a signal for starting the plant given to the controller through the terminal 12 and has its degree of opening decided by a signal amended by a temperature signal from the thermocouple 36 and a rotational speed signal from the tachometer 34. As soon as the conditions for feeding air to the waste heat recovery boiler 13 are set, a signal for closing the ancillary steam control valve 32 is given to the terminal 12.

Figure 5:
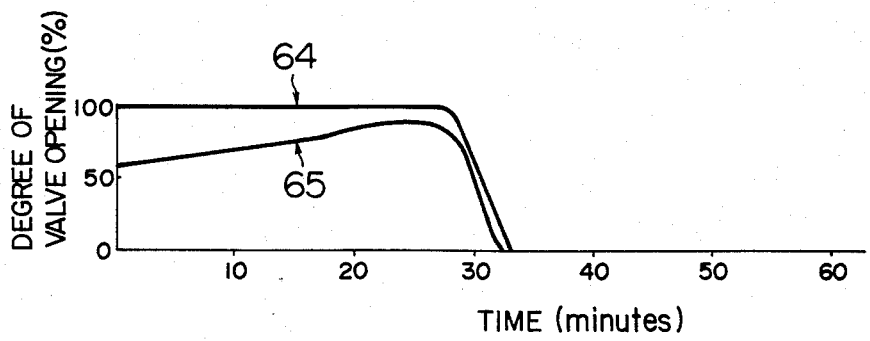
FIG. 5 is a graph showing the degree of opening of the bypass valve and the ancillary steam control valve, in chronological sequence from the time the plant is started.
Figure 6:
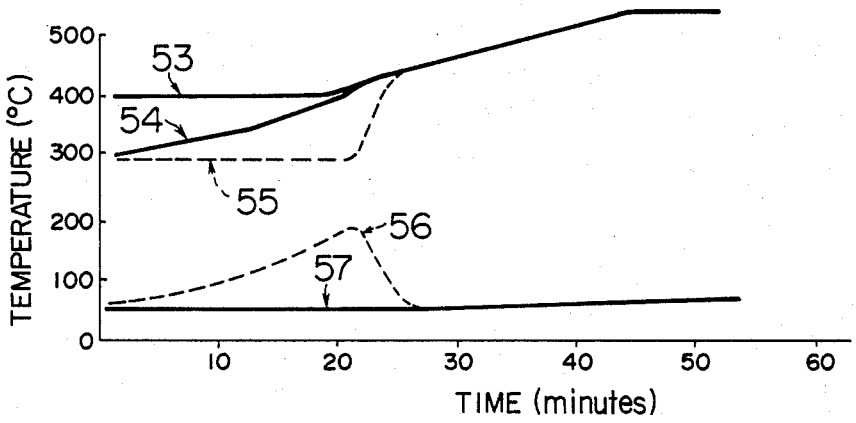
FIG. 6 is a graph showing the relation between the inlet temperature of the high pressure steam turbine and the outlet temperature of the low pressure turbine, in chronological sequence from the time the plant is started.

In FIG. 4, the speed of rotation of the steam turbine and the gas turbine, the gas turbine load and the steam turbine load are respectively indicated by the curves 50, 51 and 52. From the characteristics curves shown in FIG. 4, it will be apparent that the speed of rotation of the turbines reaches the rated speed of rotation of 3600 rpm. in about ten minutes following startup. Meanwhile, the amount of steam generated by the waste heat recovery boiler 13 is shown in FIG. 3. As indicated by a curve 59, the steam generated by the low pressure steam generator 15 begins to be generated as the turbines reach the rated speed of rotation. However, the steam is not yet ready to have conditions fully set, so that the bypass valve 26 is open to allow the steam to flow directly to the condenser 11. The hatched zone 61 represents the amount of steam flowing through the bypass valve directly to the condenser 11. The bypass valves 22 and 26 remain in full open position as indicated by a curve 64 in FIG. 5 until the conditions of the steam are set following plant startup. As indicated by a curve 58 in FIG. 3, the steam of the high pressure steam generator 14 begins to be generated after about ten minutes elapses following the gas turbine load 51 of FIG. 4 reaching a 50% level. However, the steam represented by the hatched zone 60 is directly passed through the bypass valve 22 to the condenser 11 before the conditions for the steam are set. Meanwhile, the ancillary steam control valve 32 is opened at a degree of opening shown in FIG. 5 by a curve 65, to thereby supply the ancillary steam to the steam turbine 8. In FIG. 6, the curves 53 and 57 respectively represent a high pressure steam turbine inlet temperature and a low pressure steam turbine outlet temperature of the embodiment shown in FIG. 1. In this embodiment, the high pressure turbine inlet temperature 53 agrees with the temperature 400° C. of the ancillary steam while the low pressure turbine outlet temperature 57 drops to about 50° C. because the ancillary steam does work in the turbines. A curve 54 in FIG. 6 represents the high pressure turbine inlet temperature of the embodiment shown in FIG. 2, showing that the ancillary steam flows back from the low pressure side to the high pressure side to warm up the high pressure turbine inlet. In the embodiment shown in FIG. 2, the low pressure turbine outlet temperature is substantially equal to the temperature represented by a curve 57. The curves 55 and 56, shown in broken lines in FIG. 6, represent a high pressure turbine inlet temperature and a low pressure turbine outlet temperature obtained when the ancillary steam is completely blocked. The inlet temperature 55 remains equal to a sealing steam temperature 300° C. until feeding of air to the turbines is initiated. The outlet temperature 56 gradually rises due to the windage loss and starts dropping as the air feeding is initiated.

From the foregoing description, it will be appreciated that in the embodiment shown in FIG. 2, startup of the combined plant of the single shaft type and acceleration thereof and cooling of the vicinity of the low pressure turbine outlet and warmup of the vicinity of the high pressure turbine inlet in the steam turbine can be effected simultaneously. When it is only necessary to perform cooling of the low pressure turbine, the line 39 connecting the high pressure steam control valve 20 inlet and the condenser system and the valve 29 mounted therein may be done without. Needless to say, even in this case, warmup of the high pressure turbine 9 can be effected although it is impossible to effect warmup of the high pressure steam control valve 20.

The invention can achieve the effect that the combined plant of the single shaft type comprising the invention is capable of avoiding overheating of the steam turbine at the time it is started. This is conducive to the prevention of the trouble of the turbine being tripped due to a rise in the outlet temperature of the steam turbine to an inordinately high level.

What is claimed is:

1. A combined plant comprising a gas turbine, steam turbine and a waste heat recovery boiler using exhaust gases of said gas turbine as a heat source for producing steam serving as a drive source of said steam turbine, said gas turbine and said steam turbine being connected together by a single shaft, wherein the improvement comprises:

an ancillary steam source;

ancillary steam line means connected to steam line means for introducing the steam generated by said waste heat recovery boiler to said steam turbine;

an ancillary steam control valve mounted in said ancillary steam line means whereby ancillary steam can be introduced through said ancillary steam line means into said steam turbine when said plant is started, to thereby avoid overheating of the steam turbine; and bypass line means for routing steam from the waste heat recovery boiler to a condenser by bypassing the steam turbine until the steam generated in the waste heat recovery boiler reaches a satisfactory condition at plant startup.

2. A combined plant as claimed in claim 1, wherein said steam line means leading the steam from said waste heat recovery plant comprises a high pressure steam line for introducing high pressure steam to a high pressure turbine section of said steam turbine, and a low pressure steam line for introducing low pressure steam to a low pressure turbine section of said steam turbine, and wherein said ancillary steam line means is connected between a control valve and a main steam stop valve mounted in said high pressure steam line.

3. A combined plant as claimed in claim 1, wherein said steam line means for leading the steam from said waste heat recovery boiler comprises a high pressure steam line for introducing high pressure steam into a high pressure turbine section of said steam turbine, and a low pressure steam line for introducing low pressure steam to a low pressure turbine section of said steam turbine, and wherein said ancillary steam line means is connected to the upstream side of a steam valve mounted in said low pressure steam line.

4. A combined plant as claimed in claim 3, further comprising a release line branching from said high pressure steam line in a portion thereof between a control valve and a main steam stop valve and connected to a condenser so that a portion of the ancillary steam introduced to the low pressure turbine section of the steam turbine through said low pressure steam line can be made to flow back to the high pressure turbine section to effect warmup and then can be made to flow through said release line to the condenser.

5. A combined plant as claimed in claim 3, further comprising valve means mounted in the low pressure steam line located on the upstream side of the position in which said ancillary steam line means is connected to avoid backflow of the ancillary steam.

6. A combined plant as claimed in claim 1, wherein controller means are provided for closing said ancillary steam control valve when conditions of steam of said waste heat recovery boiler are set.

* * * * *